US008950836B2

(12) United States Patent
Kim et al.

(10) Patent No.: US 8,950,836 B2
(45) Date of Patent: Feb. 10, 2015

(54) REFRIGERATOR

(71) Applicant: LG Electronics Inc., Seoul (KR)

(72) Inventors: Sanghun Kim, Seoul (KR); Seonkyu Kim, Seoul (KR); Minsup Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/864,363

(22) Filed: Apr. 17, 2013

(65) Prior Publication Data

US 2013/0278127 A1 Oct. 24, 2013

(30) Foreign Application Priority Data

Apr. 18, 2012 (KR) ..... 10-2012-0040525

(51) Int. Cl.

| | |
|---|---|
| ***A47B 96/04*** | (2006.01) |
| ***F25D 23/02*** | (2006.01) |
| ***F25D 23/04*** | (2006.01) |
| ***F25D 25/02*** | (2006.01) |
| ***F25D 23/00*** | (2006.01) |

(52) U.S. Cl.

CPC ..... *F25D 23/028* (2013.01); *F25D 23/04* (2013.01); *F25D 25/025* (2013.01); *F25D 23/00* (2013.01)

USPC ..... 312/405; 312/401

(58) Field of Classification Search

USPC ..... 312/404, 405, 408, 405.1, 321.5, 322, 312/326, 309, 310, 311

See application file for complete search history.

(56) References Cited

U.S. PATENT DOCUMENTS

| | | | | | |
|---|---|---|---|---|---|
| 2,973,236 | A * | 2/1961 | Hicks et al. | 312/408 |
| 3,107,959 | A * | 10/1963 | Maxwell, Jr. | 312/322 |
| 3,550,982 | A * | 12/1970 | Zaidan | 312/302 |
| 4,502,742 | A * | 3/1985 | Neff | 312/324 |
| 5,057,977 | A * | 10/1991 | Kurzman | 362/125 |
| 5,299,863 | A * | 4/1994 | Albright, Jr. | 312/404 |
| 7,832,816 | B2 * | 11/2010 | Compagnucci | 312/334.24 |
| 8,083,303 | B2 * | 12/2011 | Compagnucci | 312/322 |
| 8,267,493 | B2 * | 9/2012 | Kim | 312/408 |
| 2004/0232810 | A1 * | 11/2004 | Kreyenkamp | 312/322 |
| 2011/0083465 | A1 * | 4/2011 | Kim et al. | 62/449 |
| 2011/0187250 | A1 * | 8/2011 | Larson | 312/322 |
| 2013/0257255 | A1 * | 10/2013 | Hwang et al. | 312/404 |
| 2014/0132146 | A1 * | 5/2014 | Kim et al. | 312/405.1 |

* cited by examiner

*Primary Examiner* — Daniel Rohrhoff

(74) *Attorney, Agent, or Firm* — Fish & Richardson P.C.

(57) ABSTRACT

A refrigerator includes a main body and a storage room defined in the main body. The refrigerator also includes a cooling device configured to cool the storage room, a first storage area disposed inside the storage room, and a door mounted to the main body. The refrigerator further includes a second storage unit disposed at the door and a third storage unit configured to move between an inserted position inside the storage room and an extracted position in which at least a portion of the third storage unit is extracted outside of the storage room.

15 Claims, 14 Drawing Sheets

REFRIGERATOR

CROSS-REFERENCE TO RELATED APPLICATION

This application claims priority from Korean Application No. 10-2012-0040525, filed Apr. 18, 2012, the subject matter of which is incorporated herein by reference.

FIELD

The present disclosure relates to a refrigerator.

BACKGROUND

In general, a refrigerator is an apparatus which cools a storage room, such as a cold room or freezer, using a refrigeration cycle circuit having a compressor, a condenser, an expansion device and evaporator, a thermo-module, etc., and keeps storage products, such as foods, in the storage room.

A door for opening/closing the storage room is mounted in the refrigerator, and a storage such as a shelf or drawer, in which storage products are kept, can be disposed inside the storage room. A door storage such as a basket having storage products kept therein can be disposed on a rear surface of the door.

In the refrigerator, a large quantity of storage products can be kept in the storage of the storage room. As the depth of the storage room increases, a larger quantity of storage products can be kept in the storage of the storage room.

When the door of the refrigerator is opened, the storage of the storage room is positioned inside the storage room, and the door storage is moved to the outside of the storage room so as to be viewed together with the storage of the storage room from the outside.

A user can keep storage products in the storage of the storage room and the door storage according to the sizes or kinds of storage products.

SUMMARY

In one aspect, a refrigerator includes a main body, a storage room defined in the main body, and a cooling device configured to cool the storage room. The refrigerator also includes a first storage area disposed inside the storage room and a door mounted to the main body and configured to open and close the storage room. The refrigerator further includes a second storage unit disposed at the door and a third storage unit configured to move between an inserted position inside the storage room and an extracted position in which at least a portion of the third storage unit is extracted outside of the storage room. In the extracted position, the portion of the third storage unit extracted outside of the storage room defines an obtuse inclination angle with respect to a portion of a front surface of the storage room that extends from the third storage unit toward a wall of the main body to which the door is mounted.

Implementations may include one or more of the following features. For example, a width of the third storage unit may be smaller than a width of the door. When the third storage is in the inserted position inside the storage room and the door is closed, the third storage unit may be positioned adjacent to a rear surface of the door. When the third storage unit is in the inserted position inside the storage room and the door is closed, the third storage unit may be positioned adjacent to a front of the first storage area and the second storage unit may be positioned adjacent to a front of the third storage unit.

When the door is opened and the third storage unit is in the extracted position, the third storage unit may protrude from the storage room in a direction opposite to the door. When the door is opened and the third storage unit is in the extracted position, at least a portion of the third storage unit may be opposite to the second storage unit in a lateral direction. A rotational center of the third storage unit may be positioned inside the storage room. The third storage unit may include a frame rotatably mounted in an opposite direction to a rotational direction of the door and configured to store products therein.

In some implementations, the third storage unit may include a plurality of keeping portions arranged to be vertically spaced apart from one another. In these implementations, the third storage unit may have one or more openings between the plurality of keeping portions and the one or more openings may be open in a front-back direction when the third storage unit is in the inserted position inside the storage room such that the first storage area is accessible through the one or more openings. Further, in these implementations, at least one of the plurality of keeping portions may include a support, and a holder configured to restrict products supported by the support from being overturned.

In some examples, the third storage unit may include a rotary member rotatably connected to the main body and a frame configured to slide along the rotary member and configured to store products therein. In these examples, when the rotary member is rotated inside the storage room, a lateral width of the rotary member may be shorter than that between left and right walls of the storage room. Also, in these examples, a rotational axis of the rotary member may be mounted at a wall of the storage room that is closest to a rotational axis of the door.

In some implementations, the third storage unit may include a frame configured to store products therein, a first link rotatably connected to each of the main body and the frame, and a second link spaced apart from the first link and rotatably connected to each of the main body and the frame. In these implementations, the first link may be rotatably connected to a rear wall of the storage room and an end of the frame and the second link may be rotatably connected to a side wall of the storage room and a rear end of the frame. Further, in these implementations, the first link may be longer than the second link and each of the first and second links may be a bent link.

In another aspect, a refrigerator includes a main body, a storage room defined in the main body, and a cooling device configured to cool the storage room. The refrigerator also includes a first storage area disposed inside the storage room and a door rotatably mounted at a side of the main body and configured to open and close the storage room. The refrigerator further includes a second storage unit disposed at the door and a third storage unit configured to move between an inserted position inside of the storage room and an extracted position in which at least a portion of the third storage unit is extracted outside of the storage room. When the third storage unit is in the inserted position inside the storage room and the door is closed, the third storage is positioned at a rear of the door. When the door is opened and the third storage unit is in the extracted position, the third storage unit protrudes from the storage room in an opposite direction to the door at an obtuse inclination angle with respect to a front surface of the storage room that extends from the third storage unit toward the side of the main body to which the door is mounted.

Implementations may include one or more of the following features. For example, when the door is open and the third storage unit is in the extracted position, the second storage unit may be positioned at a first side of a front of the storage room and the third storage unit may be positioned at a second side of the front of the storage room that is opposite of the first side of the front of the storage room.

DETAILED DESCRIPTION

Figure 1:
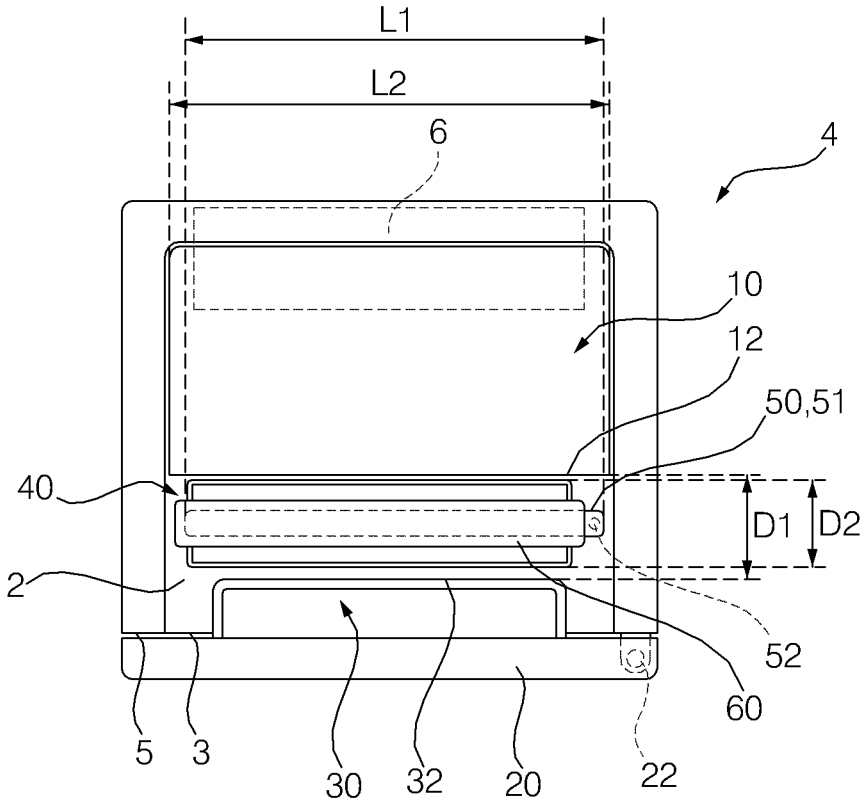
FIG. 1 is a view of a first example refrigerator when a first example third storage is inserted into a storage room, and a door is closed.
Figure 2:
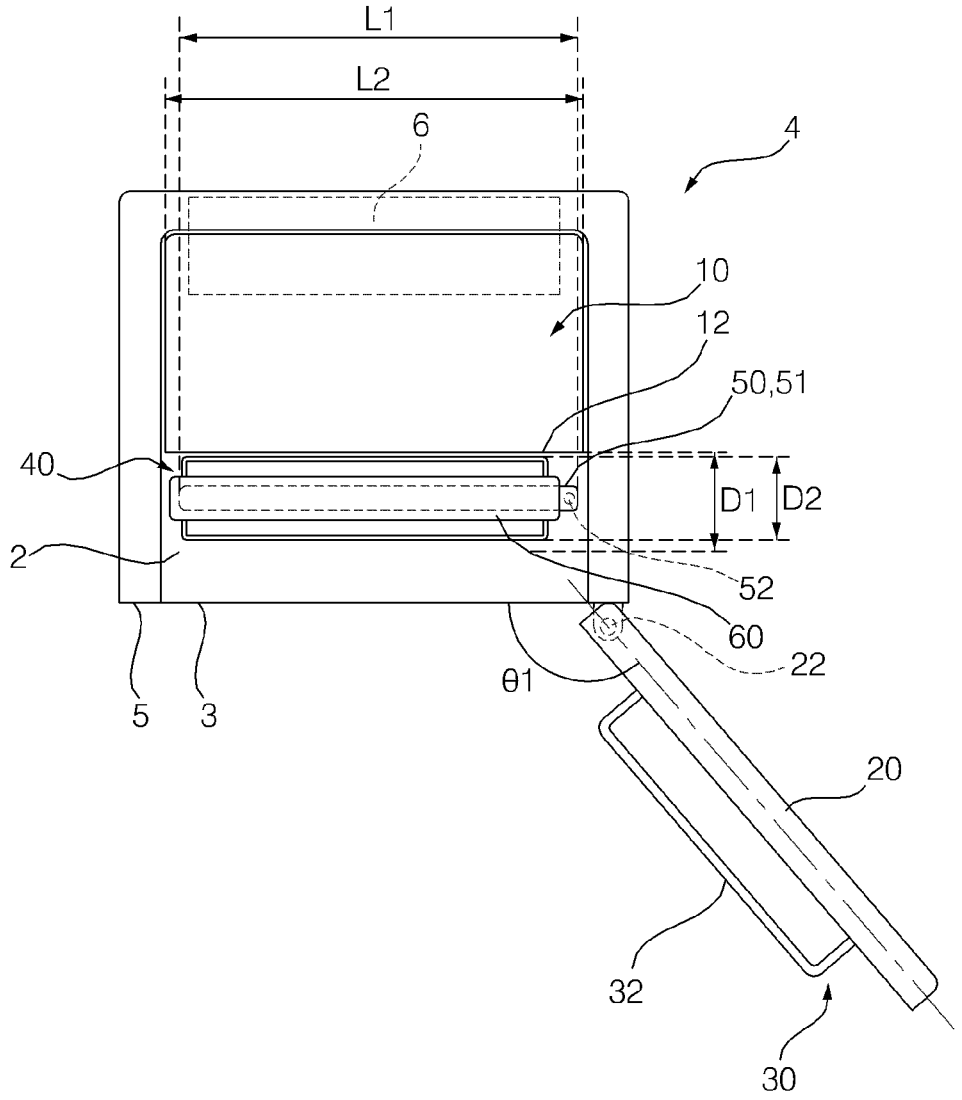
FIG. 2 is a view of the first example refrigerator when the first example third storage is inserted into the storage room, and the door is opened.
Figure 3:
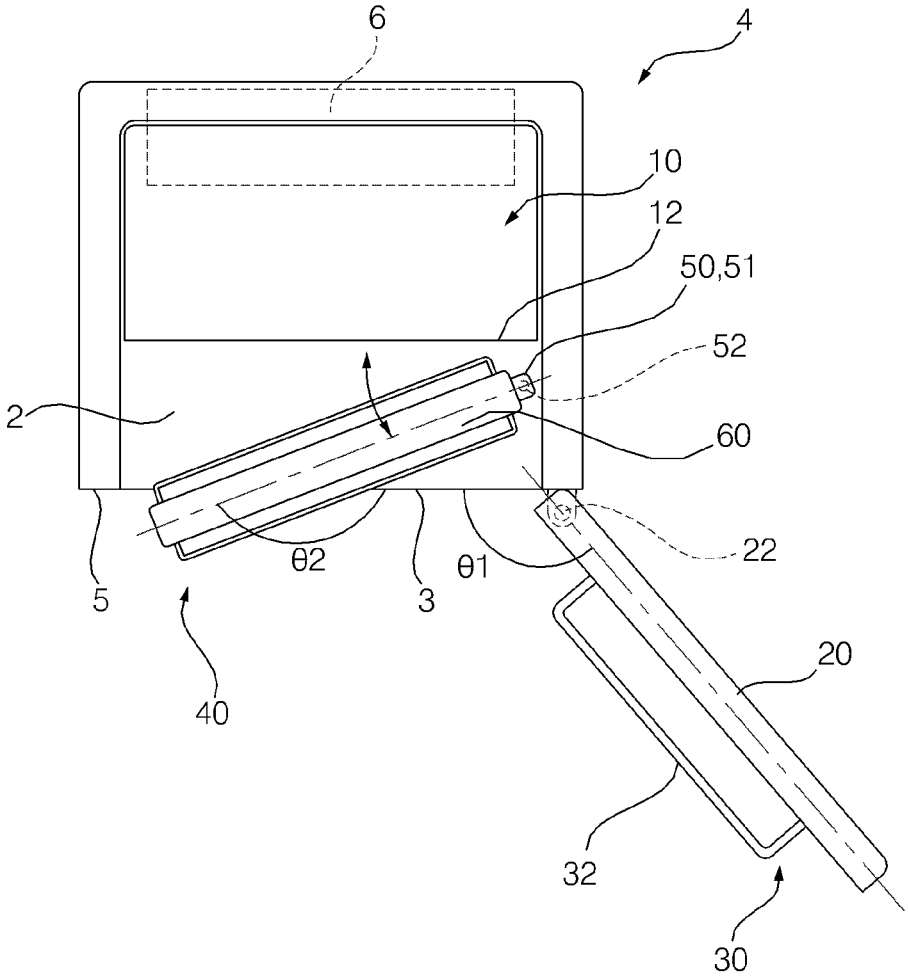
FIG. 3 is a view of the first example refrigerator when the door is opened, and the first example third storage is moving to the outside of the storage room.
Figure 4:
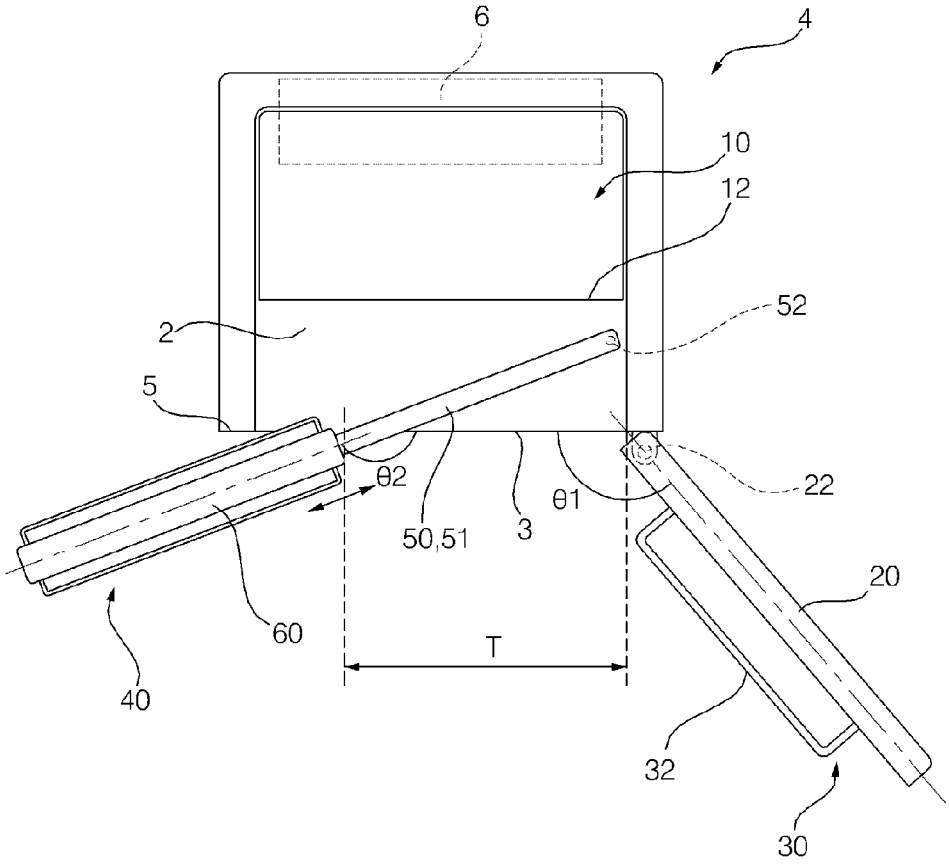
FIG. 4 is a view of the first example refrigerator when the door is opened, and the first example third storage is moving to protrude to the outside of the storage room.
Figure 5:
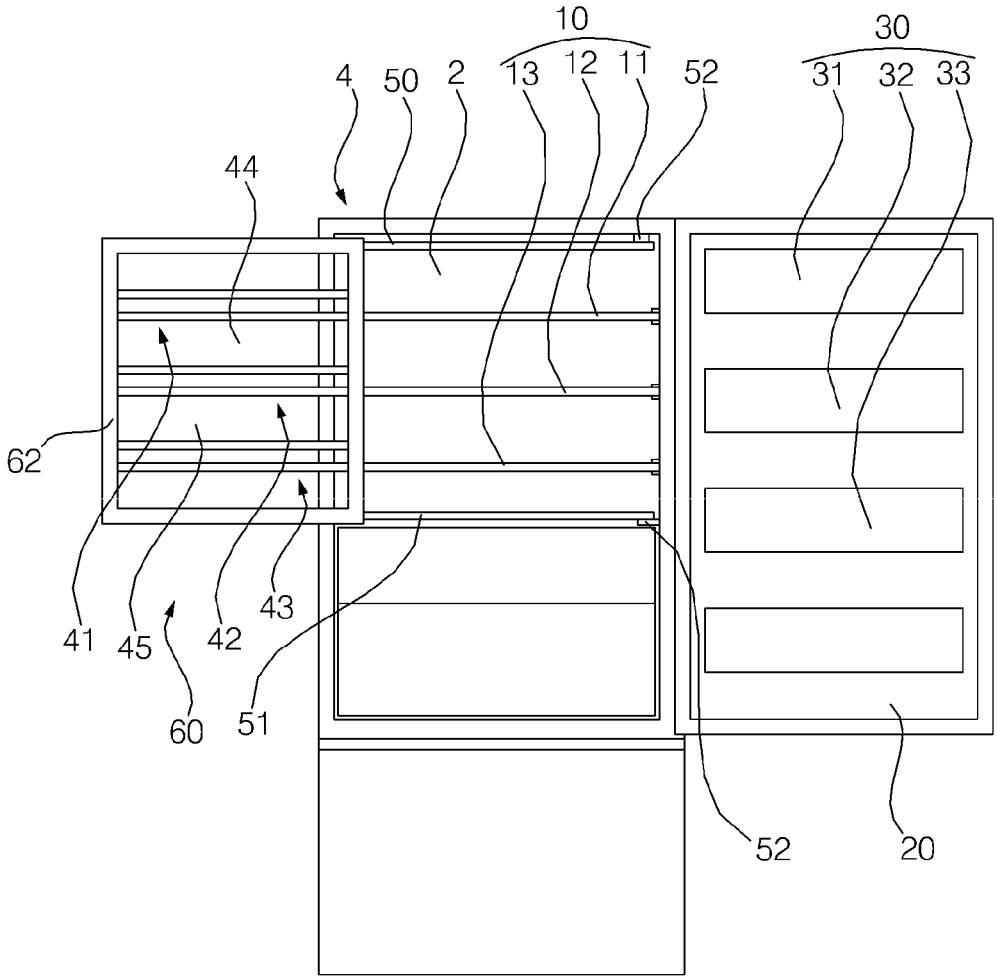
FIG. 5 is a front view of the first example refrigerator when the door is opened, and the first example third storage is moving to protrude to the outside of the storage room.

FIG. 1 illustrates an example refrigerator when an example third storage is inserted into a storage room, and a door is closed. FIG. 2 illustrates the example refrigerator when the example third storage is inserted into the storage room, and the door is opened. FIG. 3 illustrates the example refrigerator when the door is opened, and the example third storage is moving to the outside of the storage room. FIG. 4 illustrates the example refrigerator when the door is opened, and the example third storage is moving to protrude to the outside of the storage room. FIG. 5 illustrates the example refrigerator when the door is opened, and the example third storage is moving to protrude to the outside of the storage room.

The refrigerator, as shown in FIGS. 1 to 5, includes a main body 4 having a storage room 2 formed therein; a cooling device 6 cooling the storage room 2; a first storage 10 disposed inside the storage room 2; a door 20 opening/closing the storage room 2; a second storage 30 disposed at the door 20; and a third storage 40 inserted inside the storage room 2 or having at least one portion extracted to the outside of the storage room 2.

The storage room 2 in the main body 4 may have an approximately hexahedral space. The storage room 2 can have an opened front surface 3. The storage room 2 may have a size in which the first, second and third storages 10, 30 and 40 can be accommodated together. The storage room 2 can have a first region in which the first storage 10 is positioned, a second region in which the second storage 30 is positioned, and a third region in which the third storage 40 is positioned. The main body 4 can have a machine room partitioned from the storage room 2.

The cooling device 6 can include a refrigeration cycle circuit or thermo-module. The cooling device 6 can include a compressor compressing a refrigerant, a condenser condensing the refrigerant compressed in the compressor, an expansion mechanism expanding the refrigerant condensed in the condenser, and an evaporator evaporating the refrigerant expanded by the expansion mechanism. The compressor and the condenser can be mounted in the machine room formed in the main body 4. The evaporator can be mounted in the storage room 2, or can be mounted in a cooling room formed to communicate with the storage room 2. The cooling device 6 can include an evaporator fan allowing air in the storage room 2 to be circulated to the storage room 2 and the evaporator. The air sent to the evaporator by the evaporator fan can be heat-exchanged with the refrigerant and then sent to the storage room 2. The evaporator can be mounted to the outer wall of an inner casing forming the storage room 2 so as to receive heat of the storage room 2 provided through the inner casing and to heat-exchange the received heat with the refrigerant. The cooling device 6 can include a condenser fan allowing air from the outside of the refrigerator to be sent to the condenser. The air sent to the condenser by the condenser fan can be heat-exchanged with the refrigerant and then exhausted to the outside of the refrigerator.

The first storage 10 can be mounted to be positioned inside the storage room 2. The first storage 10 can be a storage of the storage room 2, in which storage products are kept in a state in which the first storage 10 is positioned inside the storage room 2. The first storage 10 can have a front-end 12 positioned inside the storage room 2. The first storage 10 can have a lateral width with which the third storage 40 can be inserted into the storage room 2 in the state in which the first storage 10 is positioned inside the storage room 2. When the third storage 40 is inserted into the storage room 2, and the door 20 is closed, the interval D1 between the front-end 12 of the first storage 10 and a rear-end 32 of the second storage 30 can be formed to have an interval greater than the lateral width D2 of the third storage 40. The first storage 10 can include one or more shelves 11, 12 and 13 mounted in the storage room 2. The one or more shelves 11, 12 and 13 may be arranged to be spaced apart from one another. The one or more shelves 11, 12 and 13 can partition the inside of the storage room 2 into a plurality of storage spaces. The one or more shelves 11, 12 and 13 can be mounted so that their positions are fixed inside the storage room 2, or can be mounted so that their heights are adjustable.

The door 20 can be slid or rotated to open/close the storage room 2. When being rotated to open/close the storage room 2, the door 20 can be mounted to the main body 4 so as to be rotated about one of left and right sides thereof. One of the left and right sides of the door 20 can be rotatably mounted to the main body 4 through a hinge member 22. The door 20 can be adhered closely to a front surface 5 of the main body 4 when the storage room 2 is closed. When being opened, the door 20 can be rotated to have an obtuse inclination angle θ1 with the front surface 3 of the storage room 2.

The second storage 30 can be moved by the door 20. The second storage 30 can be a door storage moved from the internal position of the storage room 2 to the external position of the storage room 2 when the door 20 is opened. When the door 20 is closed, at least a portion of the second storage 30 can be positioned inside the storage room 2. When the door 20 is opened, the entire second storage 30 can be positioned outside the storage room 2. When the door 20 is closed, the second storage 30 can be disposed on the surface of the door 20, which faces the storage room 2. The second storage 30 can be mounted to protrude from the rear surface of the door 20. The second storage 30 can be inserted inside the storage room 2 in a state in which the front-end of the second storage 30 is fixed to the door 20 when the door 20 is closed. The second storage 30 can include one or more baskets 31, 32 and 33 mounted to the rear surface of the door 20. The one or more baskets 31, 32 and 33 may be mounted to be spaced apart from one another. Each of the one or more baskets 31, 32 and 33 can include a box body having an opened upper surface. The one or more baskets 31, 32 and 33 can be mounted so that their positions are fixed to the door 20, or can be mounted so that their heights are adjustable.

When being inserted inside the storage room 2, the third storage 40 can be positioned between the first storage 10 and the door 20. When being extracted to the outside of the storage room 2, the third storage 40 can be positioned to be spaced apart from the first and second storages 10 and 30. The size of the third storage 40 can be smaller than that of the door 20. If the third storage 40 is inserted inside the storage room 2, and the door 20 is closed, the third storage 40 can be positioned at the rear of the door 20. If the third storage 40 is inserted inside the storage room 2, and the door 20 is closed, the third storage 40 can be positioned between the first and second storages 10 and 30. That is, if the third storage 40 is inserted inside the storage room 2, and the door 20 is closed, the third storage 40 can be positioned at the front of the first storage 10, and the second storage 30 can be positioned at the front of the third storage 40. If the door 20 is opened, and the third storage 40 is extracted to the outside of the storage room 2, the third storage 40 can be disposed to protrude in the direction opposite to the door 20. Any one of the second and third storages 30 and 40 can be positioned at one of the front, rear, left and right sides of the storage room 2, and the other of the second and third storages 30 and 40 can be positioned at the other of the front, rear, left and right sides of the storage room 2. When the door 20 is opened, the third storage 40 can be positioned at the front left side of the storage room 2. When being extracted to the outside of the storage room 2, the third storage 40 can be positioned at the front right side of the storage room 2. When the door 20 is opened, the third storage 40 can be positioned at the front right side of the storage room 2. When being extracted to the outside of the storage room 2, the third storage 40 can be positioned at the front left of the storage room 2. When being extracted to the outside of the storage room 2, at least a portion of the third storage 40 can be disposed opposite to the second storage 30 mounted to the door 20 in the lateral direction. If the door 20 is opened, and the third storage 40 is extracted to the outside of the storage room 2, the first storage 10 can be viewed between the second and third storages 30 and 40, and storage products inserted/extracted into/from the first storage 10 can be inserted/extracted between the second and third storages 30 and 40.

When being extracted to the outside of the storage room 2, the third storage 40 can be disposed to have an obtuse inclination angle θ2 with the front surface 3 of the storage room 2. When the door 20 is opened, the third storage 40 can be disposed to be inclined in the opposite direction to the door 20. The third storage 40 can be disposed in a first mode where the third storage 40 is positioned at the rear of the door 20, or can be disposed in a second mode where at least a portion of the third storage 40 is opposite to the door 20 and the second storage 30 in the lateral direction. The first mode is a mode in which the third storage 40 is inserted inside the storage room 2, and the door 20 is closed. The first mode can be a mode in which storage products are kept in the storage room 2. The second mode is a mode in which at least a portion of the third storage 40 is opposite to the door 20 and the second storage 30 in the lateral direction. The second mode can be a mode in which storage products are inserted/extracted into/from the storage room 2.

The third storage 40 can be inserted into the storage room 2 while being slidingly moved, and can be extracted to the outside of the storage room 2 while being slidingly moved. The third storage 40 can be inserted into the storage room 2 while being rotatably moved, and can be extracted to the outside of the storage room while being rotatably moved. A portion of the third storage 40 can be rotatably moved, and another portion of the third storage 40 can be slidingly moved to the rotatably moved portion. When the third storage 40 is rotatably moved, the rotational center of the third storage 40 can be positioned in the main body 4.

The description that follows focuses on an example in which a portion of the third storage 40 is rotatably moved, and another portion of the third storage 40 is slidingly moved to the rotatably moved portion. Other implementations are possible.

The third storage 40 can include rotary members 50 and 51 rotatably connected to the main body 4, and a frame 60 sliding along the rotary members 50 and 51 and having storage products kept therein.

The third storage 40 can include one or more keeping portions 41, 42 and 43 in which storage products are kept. Each of the keeping portions 41, 42 and 43 can include a shelf or basket. Each of the keeping portions 41, 42 and 43 can include at least one shelf, can include at least one basket, or can include at least one shelf and at least one basket. The keeping portions 41, 42 and 43 may be arranged to be vertically spaced apart from one another. All the keeping portions 41, 42 and 43 can be positioned at the frame 60. Some of the keeping portions 41, 42 and 43 can be positioned at the frame 60, and the other of the keeping portions 41, 42 and 43 can be positioned at the rotary members 50 and 51. The third storage 40 can have openings 44 and 45 formed between the keeping portions 41, 42 and 43. Each of the openings 44 and 45 can be formed to have a size in which storage products can be inserted/extracted into/from the first storage 10 by passing through the opening. Cooling air can pass through the openings 44 and 45. The cooling air in the first region can cool storage products in the third region by passing through the openings 44 and 45 and then flow in the second region. The cooling air in the second region can pass through the openings 44 and 45 and then return to the first region.

A rotational axis 52 that becomes a rotational center of each of the rotary members 50 and 51 can be mounted in the main body 4, and the rotary members 50 and 51 can be rotated about the rotational axis 52. When being rotated to the inside of the storage room 2, the lateral width L1 of each of the rotary members 50 and 51 can be formed shorter than the width L2 between left and right walls of the storage room 2. The rotational center of each of the rotary members 50 and 51 can be positioned inside the storage room 2. The rotational axis of each of the rotary members 50 and 51 can be mounted closely to one of the left and right walls of the storage room 2, which is closer to the rotational center of the door 20. For example, in a case where the door 20 is mounted to be laterally rotated at the left side of the main body 4, the rotational center of each of the rotary members 50 and 51 can be mounted closer to the left wall of the storage room 2. On the contrary, in a case where the door 20 is laterally rotated at the right side of the main body 4, the rotational center of each of the rotary members 50 and 51 can be mounted closer to the right wall of the storage room 2. Each of the rotary members 50 and 51 can be mounted in plural numbers in the main body 4, and the plurality of rotary members 50 and 51 can be arranged to be vertically spaced apart from one another. The upper rotary member 50 can guide an upper portion of the frame 60 to be slidingly moved. The upper rotary member 50 can be connected to one of the left and right walls of the storage room, which is closer to the rotational center of the door 20, through the rotational axis 52. The upper rotary member 50 can be connected to an upper wall of the storage room 2 through the rotational axis 52.

The lower rotary member 51 can guide a lower portion of the frame 60 to be slidingly moved. The lower rotary member 51 can be connected to one of the left and right walls of the storage room, which is closer to the rotational center of the door 20, through the rotational axis 52. The lower rotary member 51 can be connected to a lower wall of the storage room 2 through the rotational axis 52.

When being moved to protrude to the outside of the storage room 2, the frame 60 can be laterally spaced apart from the door 20. The frame 60 can have a gap T between the frame 60 and the door 20 when being protruded to the outside of the storage room 2. The gap T when the frame 60 is maximally protruded to the outside of the storage room 2 can be shorter than the lateral width between the left and right walls of the storage room 2. The gap T when the frame 60 is maximally protruded to the outside of the storage room 2 can be greater than ⅓ of the lateral width between the left and right walls of the storage room 2. The gap T when the frame 60 is maximally protruded to the outside of the storage room 2 can be smaller than the lateral width between the left and right walls of the storage room 2.

Figure 6:
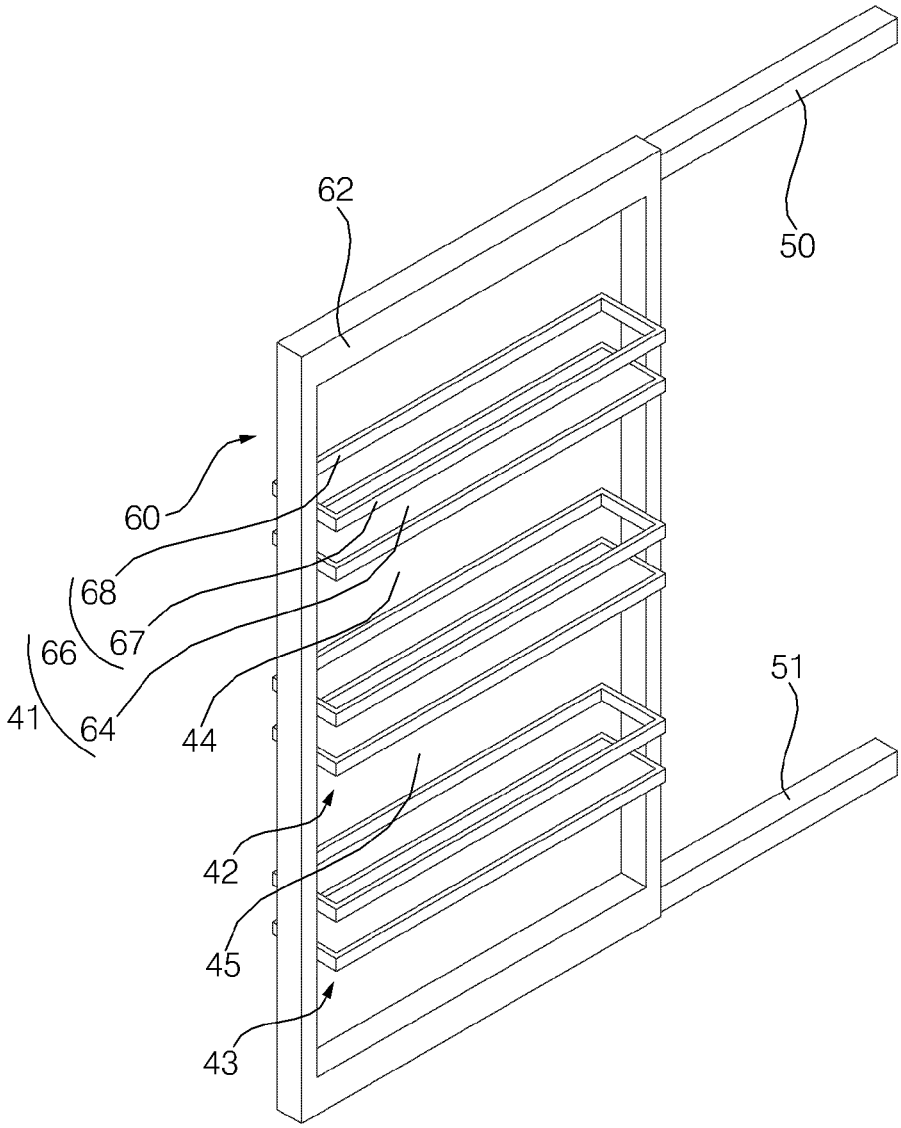
FIG. 6 is a perspective view illustrating the first example third storage.

FIG. 6 illustrates an example of the third storage. As shown, the frame 60 can include the keeping portions 41, 42 and 43, and an outer frame 62 to which the keeping portions 41, 42 and 43 are mounted.

The outer frame 62 may have a quadrangular ring shape, and can be opened in the front-back direction. The outer frame 62 can allow the rotary members 50 and 51 to be internally or externally inserted. In a case where the rotary members 50 and 51 are internally inserted into the outer frame 62, space portions into which the rotary members 50 and 51 are inserted can be formed at upper and lower portions of the outer frame 62, respectively. An upper space portion into which the rotary member 50 is internally inserted can be formed at the upper portion of the outer frame 62. A lower space portion into which the rotary member 51 is internally inserted can be formed at the lower portion of the outer frame 62.

Each of the keeping portions 41, 42 and 43 can include a support 64 having storage products put thereon, and a holder 66 that prevents the storage products put on the support 64 from being overturned. The holder 66 can include a front holder 67 preventing the storage products put on the support 64 from being overturned forward, and a rear holder 68 preventing the storage products put on the support 64 from being overturned backward.

The left side of the support 64 can be connected to a left portion of the outer frame 62, and the right side of the support 64 can be connected to a right portion of the outer frame 62. The support 64 can be formed in a planar shape. The support 64 can be horizontally disposed.

The holder 66 can be connected to the support 64, or can be integrally formed with the support 64. The holder 66 can be spaced apart from the support 64. Any one of the front and rear holders 67 and 68 can be connected to the support 64, or can be integrally formed with the support 64. The other of the front and rear holders 67 and 68 can be connected to the support 64, or can be integrally formed with the support 64.

The left side of the front holder 67 can be connected to the left portion of the outer frame 62, and the right side of the front holder 67 can be connected to the right portion of the outer frame 62. The front holder 67 can be formed in a rod shape disposed in the lateral direction. The front holder 67 can be formed in the shape of a plate body disposed along the lateral direction.

The left side of the rear holder 68 can be connected to the left portion of the outer frame 62, and the right side of the rear holder 68 can be connected to the right portion of the outer frame 62. The rear holder 68 can be formed in a rod shape disposed in the lateral direction. The rear holder 68 can be formed in the shape of a plate body disposed along the lateral direction.

Any one of the front and rear holders 67 and 68 can be disposed lower than the other of the front and rear holders 67 and 68 so that the entrance/exit of storage products can be facilitated. In each of the keeping portions 41, 42 and 43, the height of the upper end of any one of the front and rear holders 67 and 68 can be lower than that of the upper end of the other of the front and rear holders 67 and 68. In each of the keeping portions 41, 42 and 43, the front and rear holders 67 and 68 can be disposed to partially overlap with each other in the front-back direction. The upper end of one of the front and rear holders 67 and 68, of which height is lower than that of the upper holder of the other of the front and rear holders 67 and 68 can be higher than the lower end of the other of the front and rear holders 67 and 68. When the third storage 40 is inserted inside the storage room 2 or when the third storage 40 is extracted to the outside of the storage room 2, the positions of the front and rear holders 67 and 68 can be changed in the front-back direction. The third storage 40 also may be configured such that the positions of the front and rear holders 67 and 68 cannot be changed in the front-back direction. In a case where the positions of the front and rear holders 67 and 68 are not changed in the front-back direction in the third storage 40, the height of the upper end of the front holder 67 may be disposed lower than that of the upper end of the rear holder 68.

Meanwhile, the holder 66 can be formed in a quadrangular ring shape, and the space between the front and rear holders 67 and 68 can be formed to be opened in the vertical direction. The holder 66 can be spaced apart from the support 64 above the support 64. That is, the front and rear holders 67 and 68 can be integrally formed to form a ring shape that is arranged along the lateral direction.

Below, the operation of the refrigerator configured as described above will be described.

First, the door 20 can be rotated about the hinge member 22. At this time, the front surface 3 of the storage room 2 is open, and the second storage 30 can be exposed to the outside while being fixed to the door 20. As the front surface 3 of the storage room 2 is opened, the third storage 40 is exposed through the front surface 3 of the storage room 3. If a user pulls forward the third storage 40 while holding the third storage 40, the frame 60 and the rotary members 50 and 51 can be rotated about the rotational axis 52 of the rotary members 50 and 51. At this time, a portion of the frame 60 can be protruded forward from the storage room 2 by passing through the front surface 3 of the storage room 2. At this point, the third storage 40 is entirely inclined with respect to the front surface 3 of the storage room 2. Particularly, the third storage 40 can be disposed to be inclined in the opposite direction to the door 20. For example, in a case where the door 20 is inclined to have an obtuse inclination angle in the front left direction of the storage room 2, the third storage 40 can be inclined to have an obtuse inclination angle in the front right direction of the storage room 2. If a user pulls the frame 60 in the length direction of the rotary members 50 and 51 while holding the frame 60, the frame 60 is rectilinearly moved in the inclination direction of the outside of the storage room 2, and the third storage 40 is moved to the side opposite to the second storage 30 in which the keeping portions 31, 32 and 33 are mounted to the door 20. The keeping portions 41, 42 and 43 can be primarily rotated about the rotational axis 52 of the rotary members 50 and 51 and then secondarily moved rectilinearly in the direction inclined to the length direction of the rotary members 50 and 51.

At this time, the first storage 10 can be viewed between the second and third storages 30 and 40, and the second and third storages 30 and 40 can be exposed forward together with the first storage 10. When the door 20 and the third storage 40 are manipulated as described above, storage product keeping components (e.g., the shelves, baskets and keeping portions) may be spread in a wider region than that when the refrigerator does not include the third storage 40, and the user can easily recognize a large quantity of storage products. In addition, the user may be able to easily insert/extract a large quantity of storage products into/from the refrigerator.

The insertion of the third storage 40 and the closing of the door 20 can be performed in reverse order. If the user pushes the frame 60 in the direction of the rotational axis 52 of the rotary members 50 and 51 while holding the frame 60, the frame 60 can be slid along the rotary members 50 and 51. Subsequently, if the user pushes backward the frame 60, the frame 60 is inserted into the storage room 2 while being rotated, together with the rotary members 50 and 51, about the rotational axis 52 of the rotary members 50 and 51. The third storage 40 can be entirely inserted inside the storage room 2. The third storage 40 can be positioned at the front of the first storage 10. When being inserted inside the storage room 2, the third storage 40 can be disposed in the lateral direction.

If the door 20 is closed after the third storage 40 is inserted as described above, the door 20 blocks the front surface 3 of the storage room 3. At this time, the third storage 40 can be covered by the door 20 in a state in which the third storage 40 is positioned between the first and second storages 10 and 30.

Figure 7:
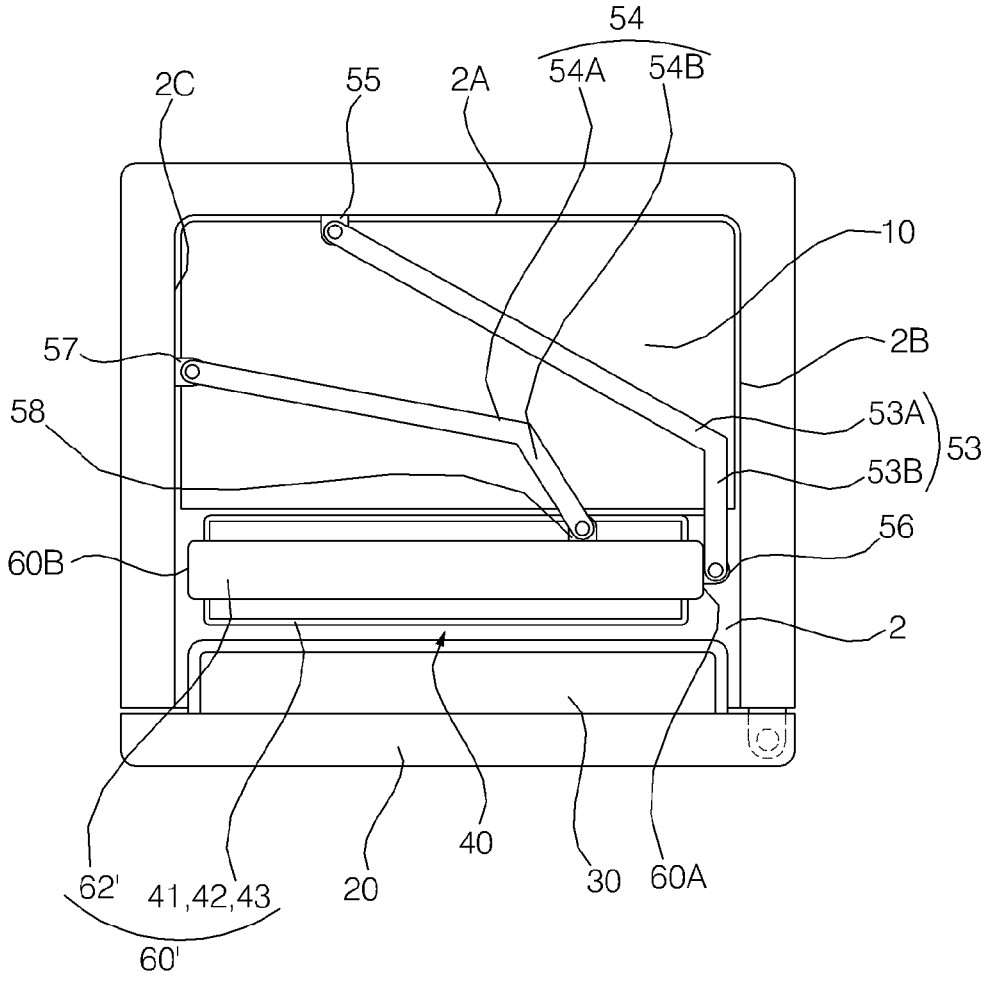
FIG. 7 is a view of a second example refrigerator when a second example third storage is inserted into a storage room, and a door is closed.
Figure 8:
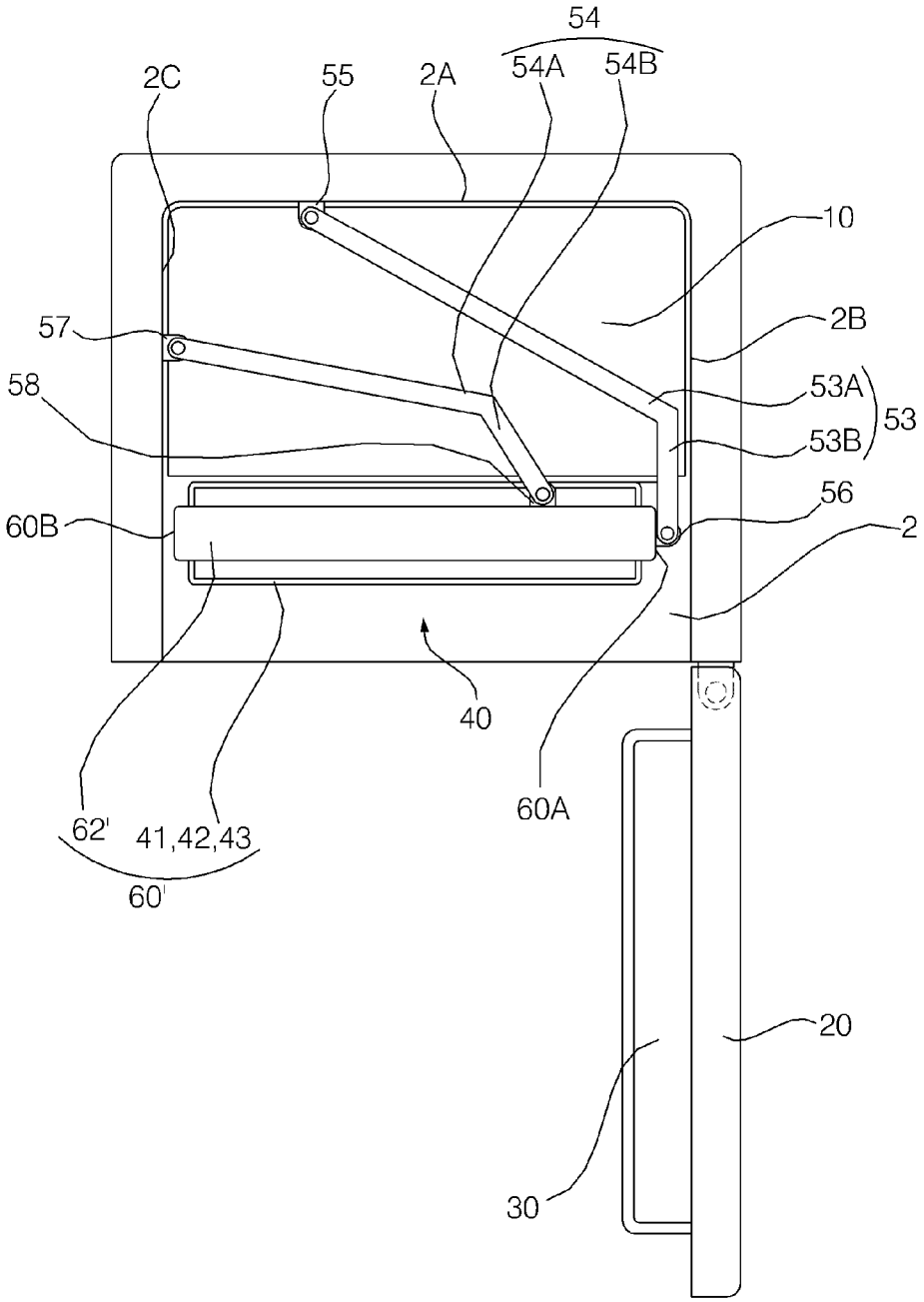
FIG. 8 is a view of the second example refrigerator when the second example third storage is inserted into a storage room, and the door is opened.
Figure 9:
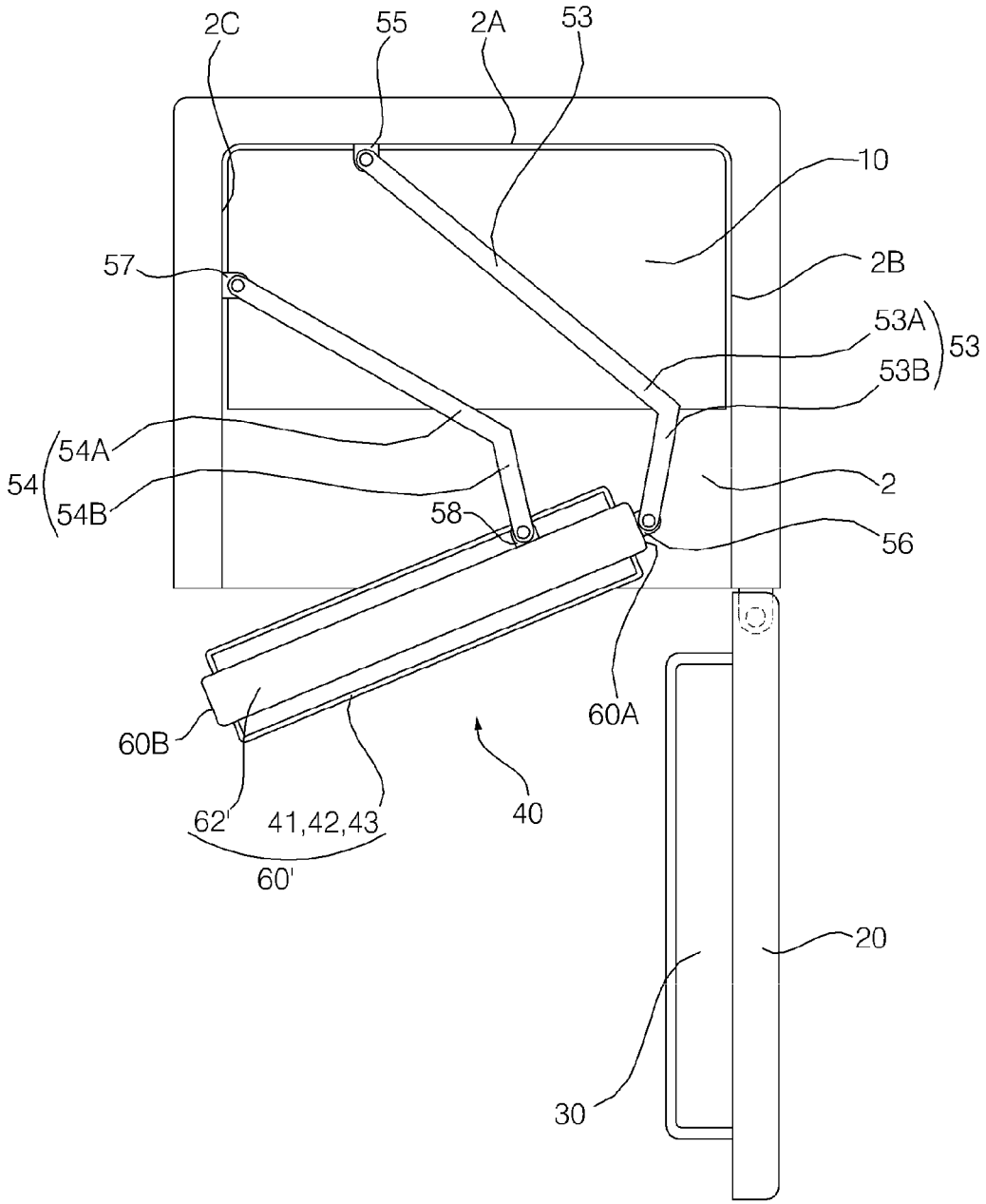
FIG. 9 is a view of the second example refrigerator when the door is opened, and the second example third storage is moving to the outside of the storage room.
Figure 10:
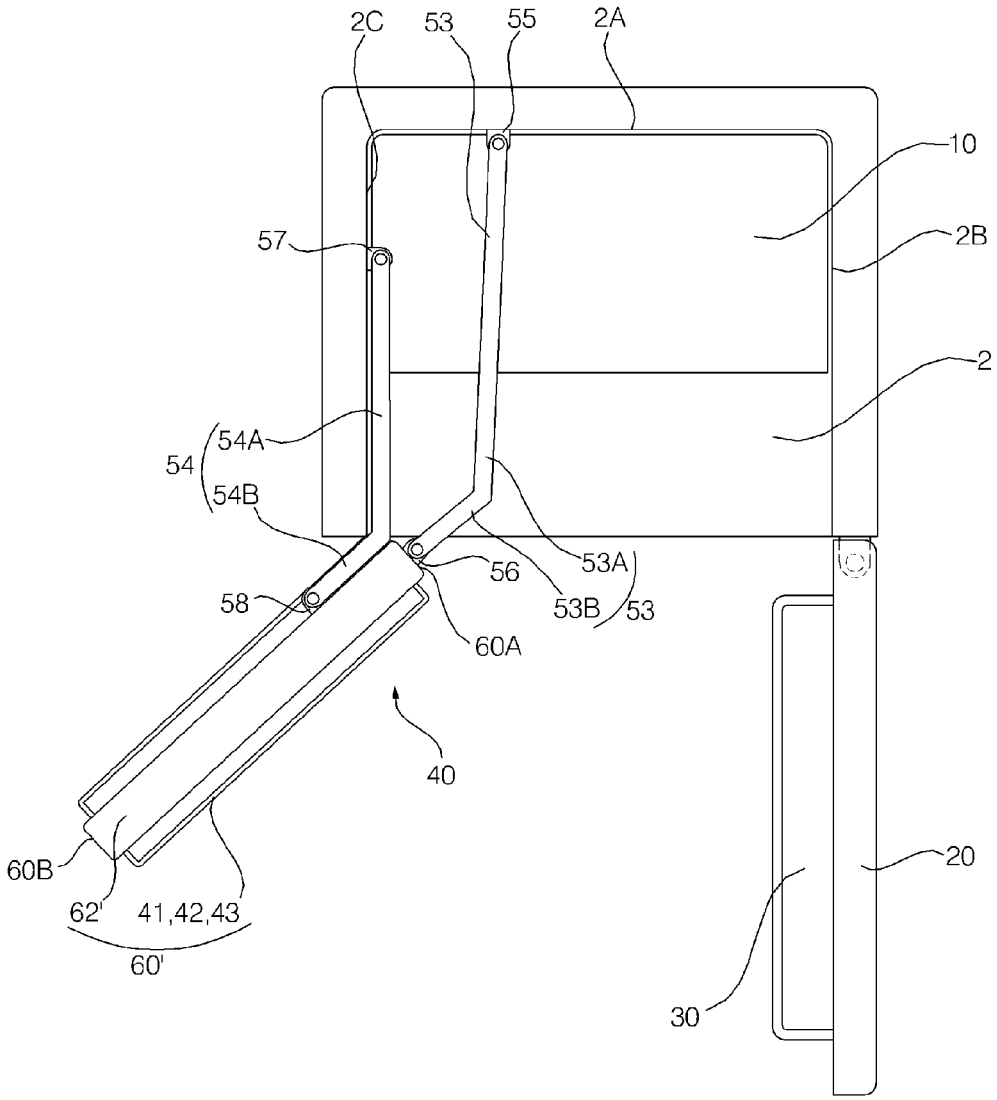
FIG. 10 is a view of the second example refrigerator when the door is opened, and the second example third storage is moving to protrude to the outside of the storage room.

FIG. 7 illustrates an example refrigerator when an example third storage is inserted into a storage room, and a door is closed. FIG. 8 illustrates the example refrigerator when the example third storage is inserted into the storage room, and the door is opened. FIG. 9 illustrates the example refrigerator when the door is opened, and the example third storage is moving to the outside of the storage room. FIG. 10 illustrates the example refrigerator when the door is opened, and the example third storage is moving to protrude to the outside of the storage room.

In the refrigerator shown in FIGS. 7-10, the detailed configuration of the third storage 40 is different from that of the third storage 40 in the refrigerator shown in FIGS. 1-6. Components other than the third storage 40 may be identical or similar to those of the refrigerator shown in FIGS. 1-6 and are designated by like reference numerals. Accordingly, their detailed descriptions are referenced, rather than repeated.

In FIGS. 7-10, the third storage 40 can include a frame 60' having storage products kept therein, a first link 53 rotatably connected to a main body 4 and the frame 60', and a second link 54 spaced apart from the first link 53 and rotatably connected to the main body 4 and the frame 60'.

The frame 60' can include keeping portions 41, 42 and 43 and an outer frame 62'. The outer frame 62' is moved while being connected to the first and second links 53 and 54. Other components identical or similar to those described above with respect to FIGS. 1-6 are designated by like reference numerals, and their detailed descriptions are referenced, rather than repeated.

The first link 53 can be rotatably connected to a rear wall 2A of the storage room 2. The first link 53 can be rotatably connected to one of left and right ends 60A and 60B of the frame 60'. The first link 53 can be connected to the outer frame 62' of the frame 60'. The first link 53 can be a bent link. The first link 53 can be longer than the second link 54. The first link 53 can include a first link portion 53A rotatably connected to the rear wall 2A of the storage room 2 through a first hinge portion 55, and a second link portion 53B bent from the first link portion 53A and rotatably connected to one of the left and right ends 60A and 60B of the frame 60' through a second hinge portion 56. The second link portion 53B can be disposed in the direction perpendicular to the frame 60' when the frame 60' is inserted inside the storage room 2 and disposed between left and right walls 2B and 2C of the storage room 2. The frame 60' can be restricted by the first link 53 in the storage room 2 so as not to be excessively rotated. The first link 53 can serve as an internal stopper capable of fixing the position at which the frame 60' is positioned inside the storage room 2.

The second link 54 can be rotatably connected to one of the left and right walls of the storage room 2. The second link 54 can be rotatably connected to the rear end of the frame 60'. The second link 54 may not be connected to the left and right ends of the frame 60' but can be connected between the left and right ends of the frame 60'. The second link 54 can be a bent link. The second link 54 can include a third link portion 54A rotatably connected to one of the left and right walls 2B and 2C of the storage room 2 through a third hinge portion 57, and a fourth link portion 54B bent from the third link portion 54A and rotatably connected to one side of the rear end of the frame 60' through a fourth hinge portion 58. The fourth link portion 54B can be disposed in the direction parallel with the frame 60' disposed to be inclined when the frame 60' is maximally protruded to the outside of the storage room 2. The frame 60' can be restricted by the second link 54 at the outside of the storage room 2 so as not to be excessively rotated. The second link 54 can serve as an external stopper capable of fixing the position at which the frame 60' is positioned outside the storage room 2.

The first and second links 53 and 54 can be mounted in plural sets between the storage room 2 and the frame 60'. The first and second links 53 and 54 can include an upper set connecting upper portions of the storage room 2 and the frame 60' and a lower set connecting lower portions of the storage room 2 and the frame 60'. The first and second links 53 and 54 can further include a middle set positioned between the upper and lower sets.

The frame 60', as shown in FIGS. 7 and 8, can be laterally disposed between the left and right walls 2B and 2C of the storage room 2 when being inserted inside the storage room 2 while being connected to the first and second links 53 and 54. The frame 60', as shown in FIG. 9, can be disposed to be inclined at an obtuse inclination angle with respect to the front surface of the storage room 2 when being moved to the outside of the storage room 2 while being connected to the first and second links 53 and 54. The frame 60', as shown in FIG. 10, can be moved in the direction opposite to the door 20 when being moved to protrude to the outside of the storage room 2 while being connected to the first and second links 53 and 54.

Figure 11:
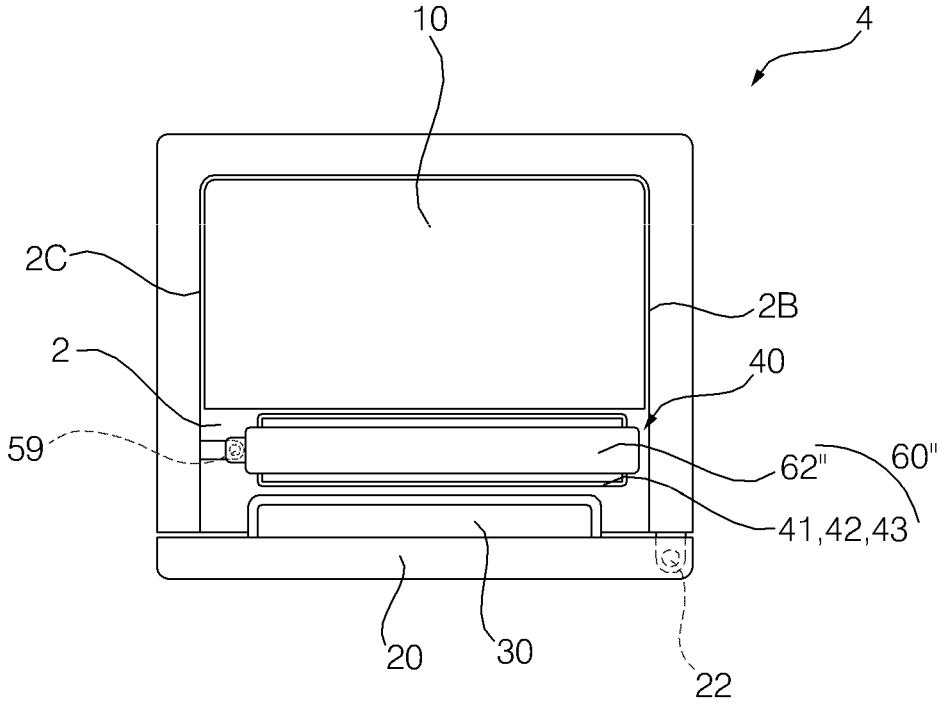
FIG. 11 is a view of a third example refrigerator when a third example third storage is inserted into a storage room, and a door is closed.
Figure 12:
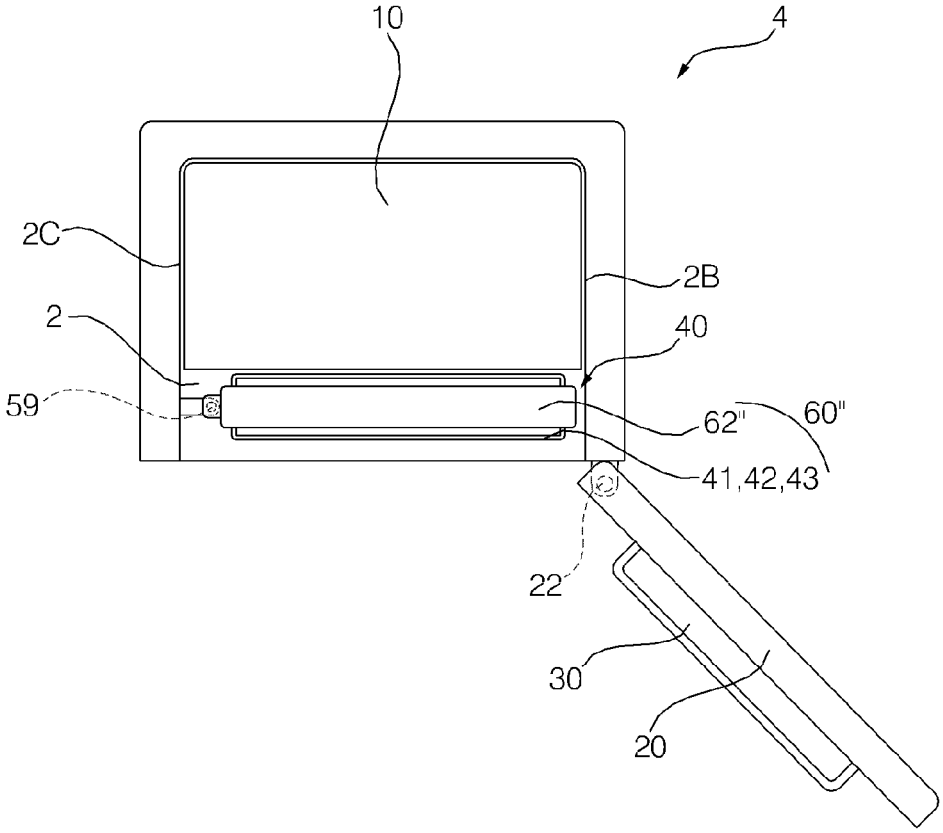
FIG. 12 is a view of the third example refrigerator when the third example third storage is inserted into a storage room, and the door is opened.
Figure 13:
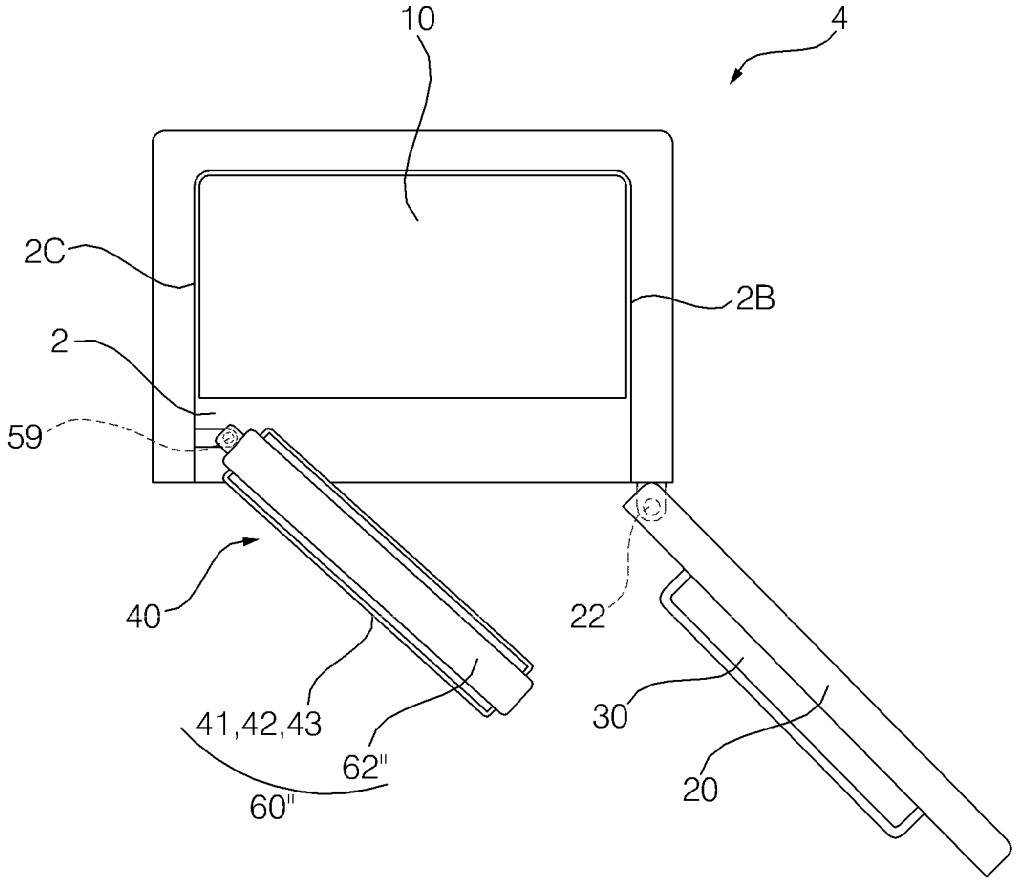
FIG. 13 is a view of the third example refrigerator when the door is opened, and the third example third storage is moving to the outside of the storage room.
Figure 14:
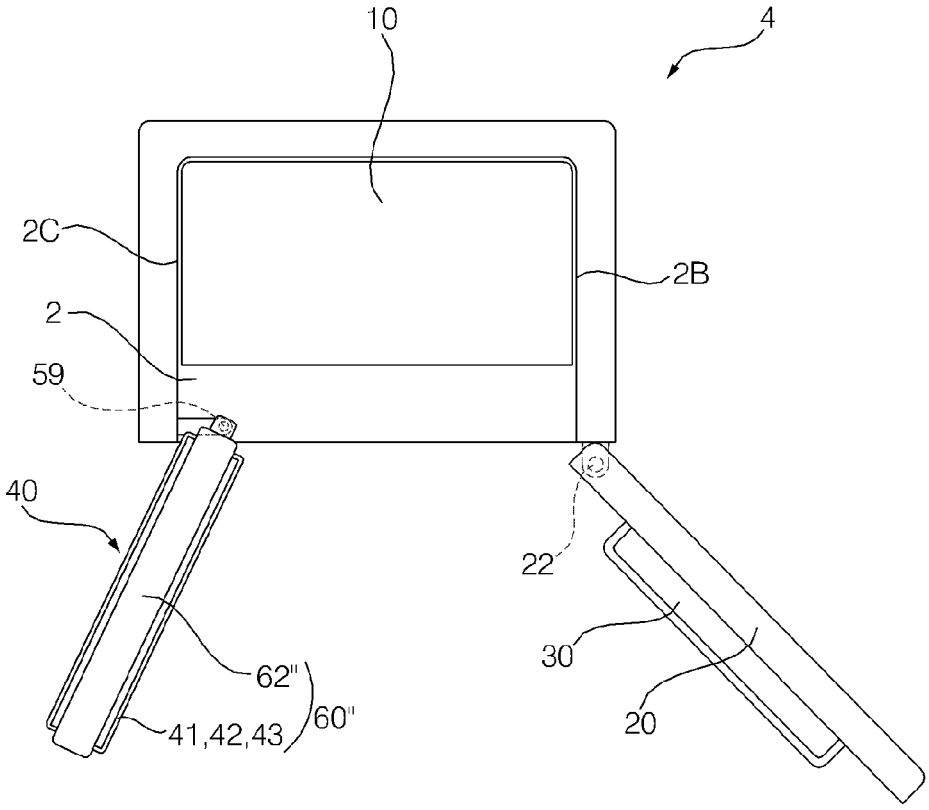
FIG. 14 is a view of the third example refrigerator when the door is opened, and the third example third storage is moving to protrude to the outside of the storage MOM.

FIG. 11 illustrates an example refrigerator when an example third storage is inserted into a storage room, and a door is closed. FIG. 12 illustrates the example refrigerator when the example third storage is inserted into a storage room, and the door is opened. FIG. 13 illustrates the example refrigerator when the door is opened, and the example third storage is moving to the outside of the storage room. FIG. 14 illustrates the example refrigerator when the door is opened, and the example third storage is moving to protrude to the outside of the storage room.

The refrigerator shown in FIGS. 11-14 includes a frame 60" mounted so that the third storage 40 is rotated in the opposite direction to the rotational direction of the door 20, and having storage products kept therein. Components other than the third storage 40 may be identical or similar to those of the refrigerator shown in FIGS. 1-6 and are designated by like reference numerals. Accordingly, their detailed descriptions are referenced, rather than repeated.

The frame 60" can include keeping portions 41, 42 and 43 and an outer frame 62". The outer frame 62" is rotated in the opposite direction to that of the door 20. Other components identical or similar to those of the refrigerator shown in FIGS. 1-6 are designated by like reference numerals, and their detailed descriptions are referenced, rather than repeated.

In a case where the door 20 is laterally mounted at one of left and right sides of the main body 4, the frame 60" can be mounted to be rotated in the opposite direction to the rotational direction of the door 20 at the other of the left and right sides of the main body 4. The frame 60" can be positioned at the rear of the door 20 when being inserted inside the storage room 2. The frame 60" can be rotated in the opposite direction to that of the door 20 when being rotated in a state in which the door 20 is opened.

A hinge member 59 that becomes a rotational center of the third storage 40 can be mounted in the main body 4. The rotational center of the third storage 40 can be positioned inside the storage room 2. The hinge member 59 that becomes the rotational center of the third storage 40 can be mounted to one of the left and right walls 2B and 2C of the storage room 2, which is more distant from the hinge member 22 of the door 20. The hinge member 59 that becomes the rotational center of the third storage 40 can be mounted closely to one of the left and right walls 2B and 2C of the storage room 2, which is more distant from the hinge member 22 of the door 20.

The frame 60", as shown in FIGS. 11 and 12, can be laterally disposed between the left and right walls 2B and 2C of the storage room 2 when being inserted inside the storage room 2 while being rotatably connected to the hinge member 59. The frame 60", as shown in FIG. 13, can be rotated to be inclined at an acute inclination angle with respect to the front surface of the storage room 2 when being moved to the outside of the storage room 2 while being rotatably connected to the hinge member 59. The frame 60", as shown in FIG. 14, can be rotated to be inclined at an obtuse inclination angle with respect to the front surface of the storage room 2 in the direction opposite to the door 20 when being moved to protrude to the outside of the storage room 2 while being rotatably connected to the hinge member 59.

As described above, structure and operational examples of a refrigerator have been described in detail with reference to appended drawings. However, the present disclosure is not limited to the above and various modifications and implementations of different examples fall within the scope of the present disclosure.

According to some implementations, storage products kept in the storage room may be distributed to the first storage positioned inside the storage room, the second storage mounted to the door, and the third storage extracted to the outside of the storage room, so that a user may be able to easily recognize the storage products kept in the storage room.

Further, storage products in the first storage may be easily extracted in a state in which the third storage is extracted to the outside of the storage room. In addition, storage products may be conveniently kept in the first storage positioned deeply in the storage room.

Further, the storage products kept in the storage room may be distributed and spread toward the left and right sides of the storage room, so that the keeping and extraction of storage products may be facilitated.

What is claimed is:

1. A refrigerator, comprising:

a main body;

a storage room defined in the main body;

a cooling device configured to cool the storage room;

a first storage area disposed inside the storage room;

a door mounted to the main body and configured to open and close the storage room;

a second storage unit disposed at the door; and a third storage unit configured to move between an inserted position inside the storage room and an extracted position in which at least a portion of the third storage unit is extracted outside of the storage room, wherein, in the extracted position, the portion of the third storage unit extracted outside of the storage room defines an obtuse inclination angle with respect to a portion of a front surface of the storage room that extends from the third storage unit toward a wall of the main body to which the door is mounted, wherein the third storage unit includes a frame configured to store products therein, a first link rotatably connected to each of the main body and the frame, and a second link spaced apart from the first link and rotatably connected to each of the main body and the frame, and wherein each of the first and second links is a bent link.

2. The refrigerator of claim 1, wherein a width of the third storage unit is smaller than a width of the door.

3. The refrigerator of claim 1, wherein, when the third storage is in the inserted position inside the storage room and the door is closed, the third storage unit is positioned adjacent to a rear surface of the door.

4. The refrigerator of claim 1, wherein, when the third storage unit is in the inserted position inside the storage room and the door is closed, the third storage unit is positioned adjacent to a front of the first storage area, and the second storage unit is positioned adjacent to a front of the third storage unit.

5. The refrigerator of claim 1, wherein, when the door is opened and the third storage unit is in the extracted position, the third storage unit protrudes from the storage room in a direction opposite to the door.

6. The refrigerator of claim 1, wherein, when the door is opened and the third storage unit is in the extracted position, at least a portion of the third storage unit is opposite to the second storage unit in a lateral direction.

7. The refrigerator of claim 1, wherein the third storage unit includes a plurality of keeping portions arranged to be vertically spaced apart from one another.

8. The refrigerator of claim 7, wherein the third storage unit has one or more openings between the plurality of keeping portions, and the one or more openings are open in a front-back direction when the third storage unit is in the inserted position inside the storage room such that the first storage area is accessible through the one or more openings.

9. The refrigerator of claim 7, wherein at least one of the plurality of keeping portions includes a support, and a holder configured to restrict products supported by the support from being overturned.

10. The refrigerator of claim 1, wherein the first link is rotatably connected to a rear wall of the storage room and an end of the frame, and the second link is rotatably connected to a side wall of the storage room and a rear end of the frame.

11. The refrigerator of claim 1, wherein the first link is longer than the second link.

12. A refrigerator, comprising:

a main body;

a storage room defined in the main body;

a cooling device configured to cool the storage room;

a first storage area disposed inside the storage room;

a door rotatably mounted at a side of the main body and configured to open and close the storage room;

a second storage unit disposed at the door; and a third storage unit configured to move between an inserted position inside of the storage room and an extracted position in which at least a portion of the third storage unit is extracted outside of the storage room, wherein, when the third storage unit is in the inserted position inside the storage room and the door is closed, the third storage is positioned at a rear of the door, and wherein, when the door is opened and the third storage unit is in the extracted position, the third storage unit protrudes from the storage room in an opposite direction to the door at an obtuse inclination angle with respect to a front surface of the storage room that extends from the third storage unit toward the side of the main body to which the door is mounted, wherein the third storage unit comprises a frame configured to store products therein, a first link rotatably connected to each of the main body and the frame, and a second link spaced apart from the first link and rotatably connected to each of the main body and the frame, wherein the first link is longer than the second link.

13. The refrigerator of claim 12, wherein, when the door is open and the third storage unit is in the extracted position, the second storage unit is positioned at a first side of a front of the storage room, and the third storage unit is positioned at a second side of the front of the storage room that is opposite of the first side of the front of the storage room.

14. The refrigerator of claim 12, wherein the third storage unit includes a frame configured to store products therein, a first link rotatably connected to each of the main body and the frame, and a second link spaced apart from the first link and rotatably connected to each of the main body and the frame.

15. A refrigerator, comprising:

a main body;

a storage room defined in the main body;

a cooling device configured to cool the storage room;

a first storage area disposed inside the storage room;

a door mounted to the main body and configured to open and close the storage room;

a second storage unit disposed at the door; and a third storage unit configured to move between an inserted position inside the storage room and an extracted position in which at least a portion of the third storage unit is extracted outside of the storage room, wherein the third storage unit comprises a frame configured to store products therein, a link assembly movably connected to each of the main body and the frame, wherein the link assembly comprises a plurality of links that guides a movement of the frame in an extracted position, and at least one of the plurality of links is a non-linear shape.

* * * * *